US009381629B1

(12) United States Patent
Bonilla et al.

(10) Patent No.: US 9,381,629 B1
(45) Date of Patent: Jul. 5, 2016

(54) RATCHET ASSEMBLY

(71) Applicants: Alex Bonilla, Fort Meyers, FL (US); Diana Bonilla, Fort Meyers, FL (US)

(72) Inventors: Alex Bonilla, Fort Meyers, FL (US); Diana Bonilla, Fort Meyers, FL (US)

( * ) Notice: Subject to any disclaimer, the term of this patent is extended or adjusted under 35 U.S.C. 154(b) by 250 days.

(21) Appl. No.: 14/105,488

(22) Filed: Dec. 13, 2013

(51) Int. Cl.

| | |
|---|---|
| ***B25B 23/16*** | (2006.01) |
| ***B25G 1/04*** | (2006.01) |
| ***B25G 1/06*** | (2006.01) |
| ***B25G 1/00*** | (2006.01) |

(52) U.S. Cl.
CPC ..... *B25B 23/16* (2013.01); *B25G 1/005* (2013.01); *B25G 1/043* (2013.01); *B25G 1/066* (2013.01)

(58) Field of Classification Search
CPC ..... B25B 23/16; B25B 7/12; B25B 7/04; B25B 7/22; B25G 1/005; B25G 1/043; B25G 1/066
USPC ..... 81/427.5, 367, 177.2, 177.8
See application file for complete search history.

(56) References Cited

U.S. PATENT DOCUMENTS

| | | | | |
|---|---|---|---|---|
| 1,412,205 | A | 4/1922 | Fisher | |
| 4,519,278 | A * | 5/1985 | Heldt | B25B 7/00 81/124.4 |
| 4,742,736 | A * | 5/1988 | Williams | B25B 7/00 81/303 |
| 5,193,419 | A | 3/1993 | Lee | |
| 5,377,567 | A * | 1/1995 | Sorensen | B25B 27/0071 81/367 |
| D432,890 | S | 10/2000 | Webb | |
| 6,243,901 | B1 * | 6/2001 | Elsener | B25F 1/003 30/161 |
| 6,796,205 | B2 * | 9/2004 | Wickes | B25B 7/18 81/177.8 |
| D617,160 | S | 6/2010 | Spiller | |
| 2004/0020331 | A1 * | 2/2004 | Lee | B25B 13/461 81/177.2 |
| 2012/0247283 | A1 | 10/2012 | Neumann | |
| 2013/0081231 | A1 | 4/2013 | Huang | |

* cited by examiner

*Primary Examiner* — Hadi Shakeri

(57) ABSTRACT

A ratchet assembly for applying additional torque to a clamping pliers includes a ratchet coupled to a clamping pliers. The ratchet has an adjustable rotation. A handle is coupled to the ratchet. The handle may be gripped by a user so the user rotates the clamping pliers. A drive is coupled to the clamping pliers. The drive may insertably receive an end of a wrench.

8 Claims, 3 Drawing Sheets

RATCHET ASSEMBLY

BACKGROUND OF THE DISCLOSURE

Field of the Disclosure

The disclosure relates to ratchet devices and more particularly pertains to a new ratchet device for applying additional torque to a clamping pliers.

SUMMARY OF THE DISCLOSURE

An embodiment of the disclosure meets the needs presented above by generally comprising a ratchet coupled to a clamping pliers. The ratchet has an adjustable rotation. A handle is coupled to the ratchet. The handle may be gripped by a user so the user rotates the clamping pliers. A drive is coupled to the clamping pliers. The drive may insertably receive an end of a wrench.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
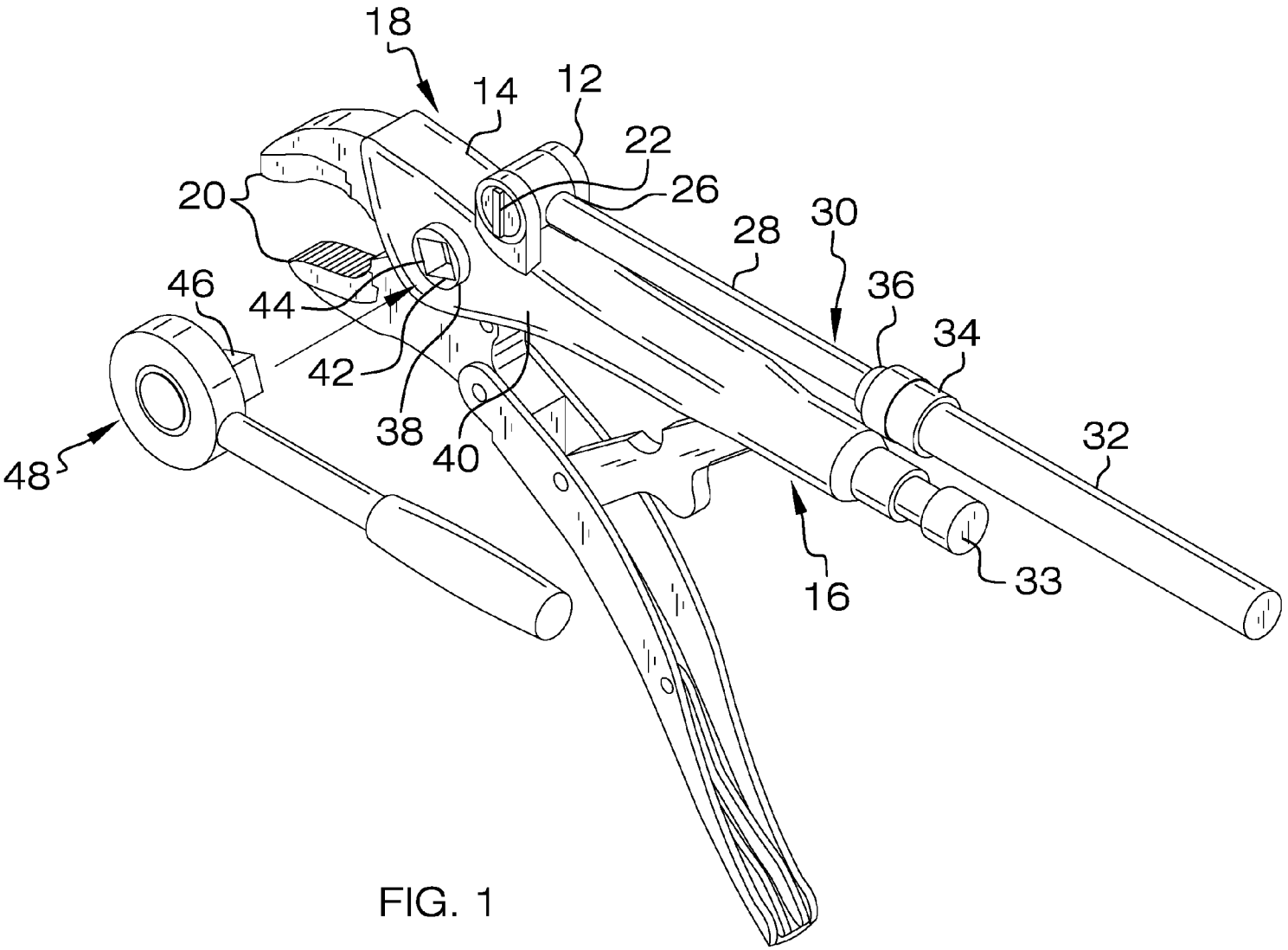
FIG. 1 is a perspective view of a ratchet assembly according to an embodiment of the disclosure.
Figure 2:
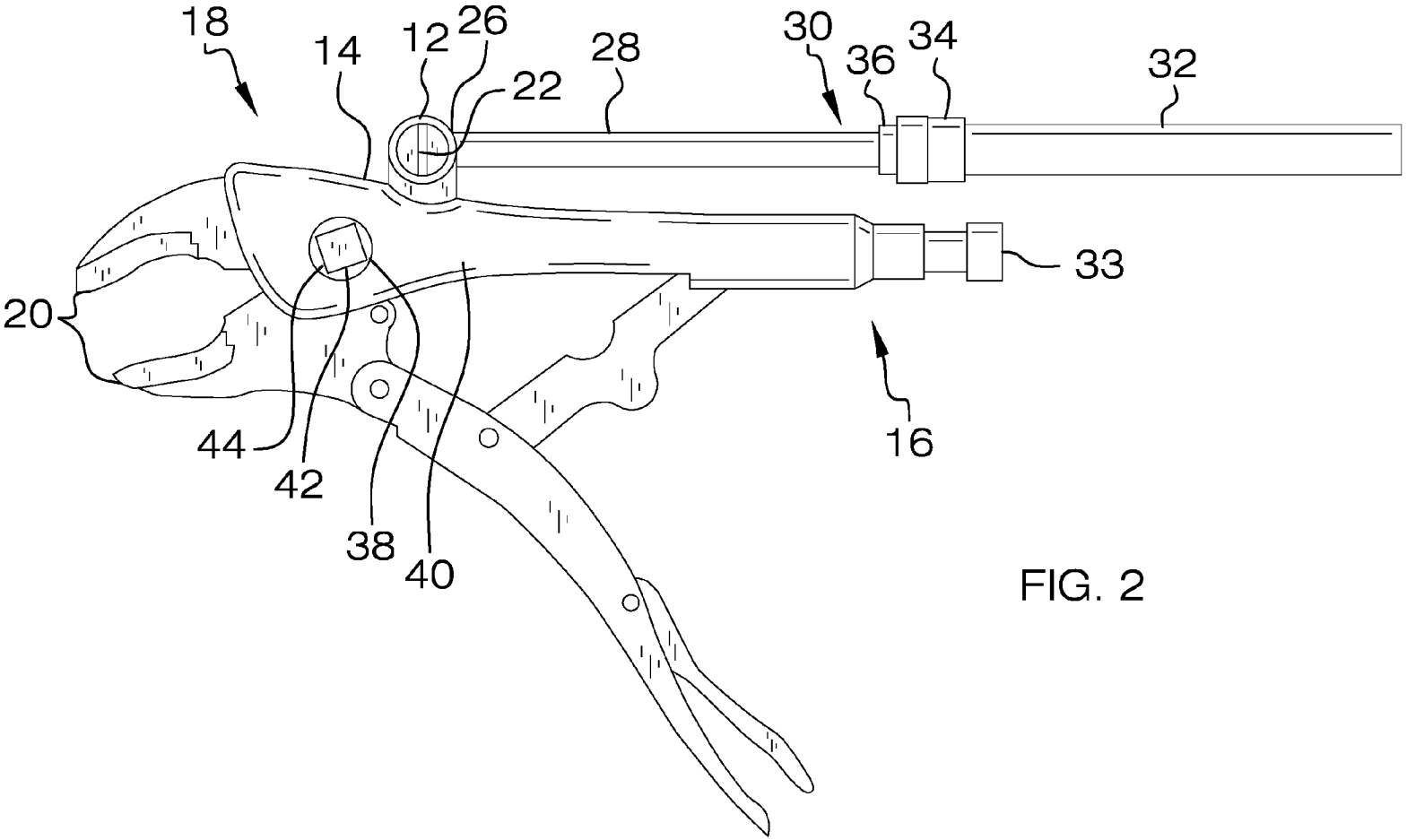
FIG. 2 is a left side view of an embodiment of the disclosure.
Figure 3:
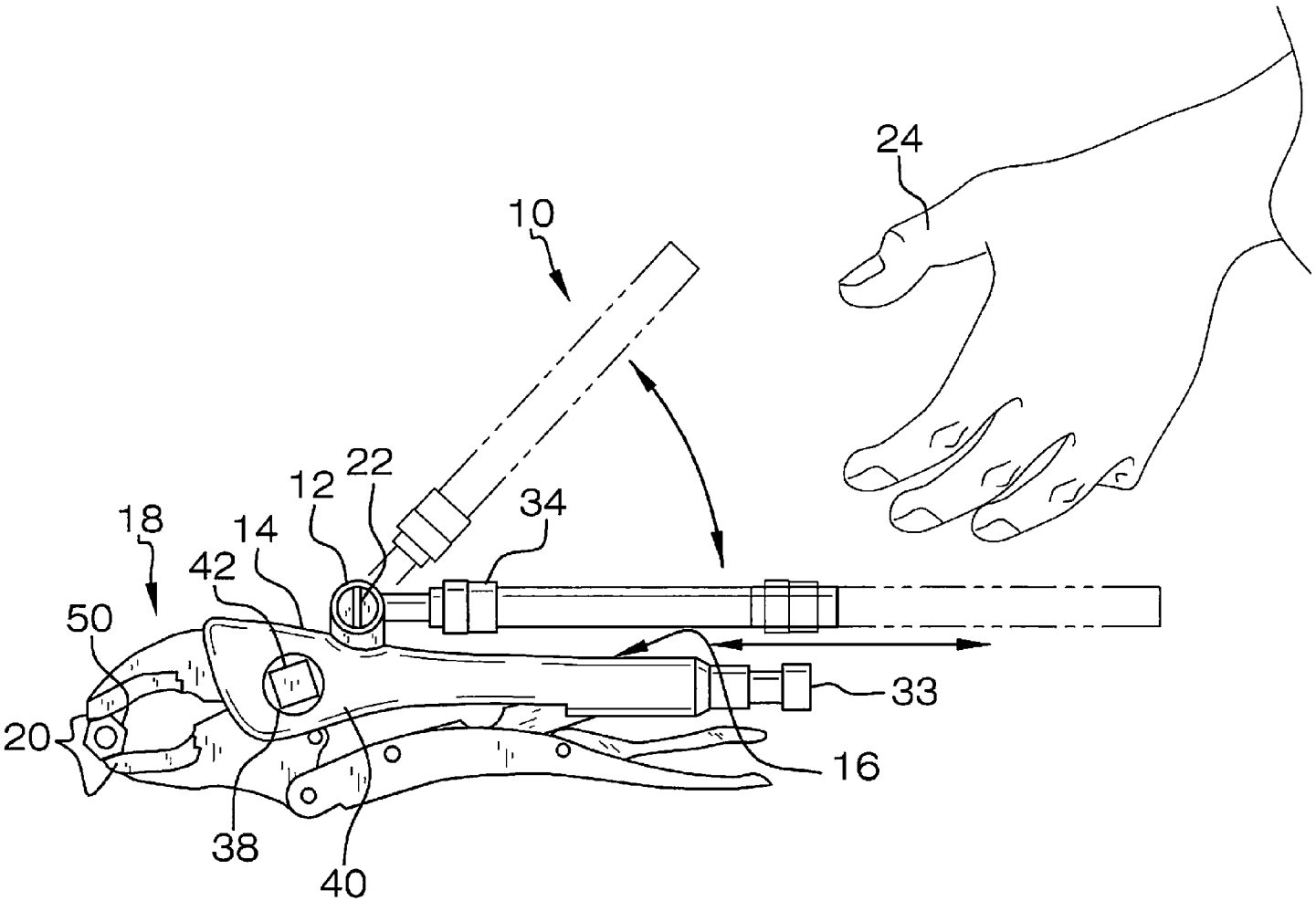
FIG. 3 is a left side perspective view of an embodiment of the disclosure.

With reference now to the drawings, and in particular to FIGS. 1 through 3 thereof, a new ratchet device embodying the principles and concepts of an embodiment of the disclosure and generally designated by the reference numeral 10 will be described.

As best illustrated in FIGS. 1 through 3, the ratchet assembly 10 generally comprises a ratchet 12 coupled to a top side 14 of a top one of a pair of arms 16 of a clamping pliers 18 proximate a pair of jaws 20 of the clamping pliers 18. The ratchet 12 has an adjustable rotation. Moreover, the clamping pliers 18 may be a Vice Grip of any conventional design or other similar clamping pliers 18. A knob 22 is rotatably coupled to the ratchet 12. The knob 22 may be gripped by a user 24. Further, the knob 22 is manipulated by the user 24 so the knob 22 selectively determines a rotational direction of the ratchet 12. The ratchet 12 may be a mechanical ratchet of any conventional design.

A first end 26 of a first portion 28 of a handle 30 is coupled to the ratchet 12. The first portion 28 of the handle 30 is coextensive with the top arm 16 of the clamping pliers 18. Additionally, the first portion 28 of the handle 30 may have a length between 7 cm and 10 cm. A second portion 32 of the handle 30 is slidably coupled to the first portion 28 of the handle 30. The second portion 32 of the handle 30 has a diameter that is greater than a diameter of the first portion 28 of the handle 30. Lastly, the second portion 32 of the handle 30 may have a length between 10 cm and 15 cm.

The handle 30 has a telescopically adjustable length. Additionally, the second portion 32 of the handle 30 extends beyond an end 33 of the top arm 16 of the clamping pliers 18. A retainer 34 is coupled to a first end 36 of the second portion 32 of the handle 30. The retainer 34 selectively engages the first portion 28 of the handle 30. Moreover, the retainer 34 retains the second portion 32 of the handle 30 at a selected position. The handle 30 may be gripped by the user 24 so the user 24 rotates the clamping pliers 18.

A drive 38 is coupled to a first lateral side 40 of the top arm 16 of the clamping pliers 18 proximate the pair of jaws 20 of the clamping pliers 18. Continuing, a drive well 42 extends laterally into a first lateral side 44 of the drive 38. The drive well 42 may insertably receive an end 46 of a wrench 48. The wrench 48 may be a socket wrench of any conventional design. Further, the drive 38 may be a ⅜ inch socket drive of any conventional design.

In use, the clamping pliers 18 are selectively positionable on a fastener 50. The fastener 50 may be a nut and bolt of any conventional design. Continuing, the user 24 grips the handle 30 so the user 24 rotates the clamping pliers 18 if the fastener 50 is in a hard to reach location. The handle 30 is selectively lengthened so the user 24 selectively applies an increased amount of rotational torque to the fastener 50. Continuing, the user 24 selectively inserts the end 46 of the wrench 48 into the drive well 42 in the drive 38. The user 24 applies rotational torque to the wrench 48 so the wrench 48 rotates the clamping pliers 18. Further, the user 24 may use either the handle 30 or the wrench 48 to rotate the clamping pliers 18 depending upon the orientation of the clamping pliers 18 on the fastener 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A ratchet assembly for comprising:

clamping pliers having a pair of arm and a pair of jaws, the pair of jaws defining a pivot axis at a pivot point;

a ratchet coupled to the clamping pliers, said ratchet having an adjustable rotation, said ratchet being coupled to a top side of a top arm of said pair of arms proximate said pair of jaws of said clamping pliers, said top side extending parallel to said pivot axis;

a handle coupled to said ratchet such that said handle is coplanar with said pair of arms and extends along and from said top side of said top arm of said pair of arms wherein said handle is configured to be gripped by a user; and a drive coupled to a lateral side of said top arm of the clamping pliers, said drive being positioned between said ratchet and said pair of jaws and proximate said pivot point of said pair of jaws, the lateral side extending perpendicular to said pivot axis, said drive being configured to insertably receive an end of a wrench.

2. The assembly according to claim 1 further comprising a knob rotatably coupled to said ratchet wherein said knob is configured to be gripped by a user.

3. The assembly according to claim 1 further comprising said knob being operationally coupled to said ratchet wherein a rotational direction of said ratchet is adjustable by manipulation of said knob.

4. The assembly according to claim 1 further comprising a first end of a first portion of said handle being coupled to said ratchet wherein said first portion of said handle is coextensive with said top arm of the clamping pliers.

5. The assembly according to claim 1 further comprising a second portion of said handle being slidably coupled to a first portion of said handle wherein said handle has a telescopically adjustable length.

6. The assembly according to claim 5 further comprising wherein said second portion of said handle extends beyond an end of said top arm of the clamping pliers.

7. The assembly according to claim 1 further comprising a drive well extending laterally into a first lateral side of said drive wherein said drive well is configured to insertably receive the end of the wrench.

8. A ratchet assembly comprising:

clamping pliers having a pair of arm and a pair of jaws, the pair of jaws defining a pivot axis at a pivot point;

a ratchet coupled to a top side of a top arm of said pair of arms of the clamping pliers proximate said pair of jaws of said clamping pliers, said top side extending parallel to said pivot axis, said ratchet having an adjustable rotation;

a knob rotatably coupled to said ratchet wherein said knob is configured to be gripped by a user, said knob being manipulated by the user wherein said knob selectively determines a rotational direction of said ratchet;

a first end of a first portion of a handle being coupled to said ratchet such that said handle is coplanar with said top arm and extends along and from said top side of said top arm wherein said first portion of said handle is coextensive with the top arm of the clamping pliers, a second portion of said handle being slidably coupled to said first portion of said handle wherein said handle has a telescopically adjustable length wherein said second portion of said handle extends beyond an end of the top arm of the clamping pliers wherein said handle is configured to be gripped by a user; and a drive coupled to a lateral side of the top arm of the clamping pliers proximate the pair of jaws of the clamping pliers, the lateral side extending perpendicular to said pivot axis, said drive being positioned between said ratchet and said pair of jaws and proximate said pivot point of said pair of jaws, said drive being configured to insertably receive an end of a wrench:

a drive well extending laterally into a first lateral side of said drive wherein said drive well is configured to insertably receive an end of the wrench;

wherein the clamping pliers being selectively positionable on a fastener wherein the user grips said handle wherein the user rotates the clamping pliers;

wherein said handle being selectively lengthened wherein the user selectively applies an increased amount of rotational torque to the fastener; and wherein the user selectively inserts the end of the wrench into said drive well in said drive wherein the user applies rotational torque to the wrench wherein the wrench rotates the clamping pliers.

* * * * *